United States Patent [19]

Wheeler

[11] 4,225,014

[45] Sep. 30, 1980

[54] SELF-ALIGNING ELEVATOR CONNECTION

[75] Inventor: John H. Wheeler, Dallas, Tex.

[73] Assignee: The Texacone Company, Dallas, Tex.

[21] Appl. No.: 964,154

[22] Filed: Nov. 28, 1978

[51] Int. Cl.[2] ..... B66B 9/00

[52] U.S. Cl. ..... 187/1 R; 248/635; 267/153

[58] Field of Search ..... 187/1 R, 17; 248/632, 248/634, 635; 267/140, 141, 153

[56] References Cited

U.S. PATENT DOCUMENTS

| | | | |
|---|---|---|---|
| 969,322 | 9/1910 | Anderson | 187/1 R |
| 1,033,657 | 7/1912 | Bashaw | 267/60 |
| 1,271,534 | 7/1918 | Bickford | 187/1 R |
| 1,951,118 | 3/1934 | Ackerman | 254/93 R |
| 2,571,281 | 10/1951 | Neher | 267/153 |
| 2,637,454 | 5/1953 | Rowe | 414/584 |
| 2,904,009 | 9/1959 | Salter | 92/181 R |
| 3,043,401 | 7/1962 | Hallene et al. | 187/17 |
| 3,369,802 | 2/1968 | Wallace et al. | 267/153 |
| 3,831,923 | 8/1974 | Meldrum | 267/153 |

FOREIGN PATENT DOCUMENTS

| | | | |
|---|---|---|---|
| 44837 | 4/1935 | France | 248/632 |
| 1437678 | 6/1976 | United Kingdom | 248/635 |

*Primary Examiner*—Robert J. Spar
*Assistant Examiner*—Kenneth Noland
*Attorney, Agent, or Firm*—Richards, Harris & Medlock

[57] ABSTRACT

An elevator connection (22) is provided for joining an elevator car (10) to a hydraulic piston (20) which raises and lowers the elevator car (10). Misalignment between the hydraulic piston (20) and guide rails (14) of an elevator shaft (12) is accommodated by a washer assembly (28) and cushion assembly (30) disposed between a stud bolt (32) and the top of the hydraulic piston (20). Washer assembly (28) includes an elastomeric disc (34) together with springs (36) which enclose a tubular washer (42) having a convex lower end surface. Cushion assembly (30) comprises an elastomeric disc (46) with springs (48) on either side thereof and enclosing a wobble tube (54) having convex end surfaces (56, 58). The elevator car (10) is held securely to the hydraulic piston (20) but is permitted to offset slightly from the piston (20) and tilt to accommodate misalignment of elevator guide rails (14) with the hydraulic piston (20).

13 Claims, 5 Drawing Figures

SELF-ALIGNING ELEVATOR CONNECTION

TECHNICAL FIELD

This invention relates to hydraulic elevator equipment, and more particularly to a connector for joining an elevator to a hydraulic piston.

BACKGROUND ART

Elevators utilizing hydraulic pistons to raise and lower the elevator car have been in use for many years. Hydraulic piston elevators are best adapted for use in buildings having only a few floor levels since the piston shaft which lifts the elevator car must be of a length to raise the elevator to its maximum height. To accommodate the piston shaft a cylinder must be sunk in the ground beneath the building for the full length of the piston shaft. However, the cylinder must be installed in the ground so that it is parallel to vertical guide rails which align the elevator car in its travel within the building.

Hydraulic elevators as described above suffer serious degradation in performance if the piston cylinder is not accurately aligned with the guide rails. Misalignment can occur due to faulty installation or due to extended usage which can cause the guide rails to become misaligned with respect to the piston cylinder. Misalignment causes the sliding guides on the elevator car to bind the guide rails which in turn impedes the movement of the elevator car and can cause undesirable shaking and vibration. The misalignment becomes more exaggerated as the car travels further up in the building. In addition the misalignment can increase the wear on the machinery which in turn leads to increased service costs and decreased operational life time.

In U.S. Pat. No. 3,043,401 to Hellene there is disclosed a shackle spring mounting for hydraulic elevators. This mounting is designed to isolate the elevator car from vibration and to accommodate misalignment between the hydraulic cylinders and the elevator guide rails. However, it does not provide a rigid metal-to-metal contact between car and piston and in particular does not maintain such contact during misalignment between car and piston.

A need has thus arisen for a self-aligning elevator connection which will permit the elevator car to align with the guide rails in the elevator shaft while maintaining a secure connection to the hydraulic piston which lifts the elevator car. The connection must maintain positive metal contact between the elevator car and the piston and at the same time allow the elevator car to pivot to a limited extent about the top of the piston to accommodate any misalignment.

DISCLOSURE OF THE INVENTION

In accordance with the present invention where a hydraulic elevator has a car that is supported by a platform and guided by vertical rails in an elevator shaft with the car and platform raised and lowered by a hydraulic piston, apparatus is provided for connecting the piston to the platform to support the platform and accommodate misalignment between the piston and the guide rails. The apparatus comprises a washer assembly located on the upper surface of the platform and having an elastomeric disc with a central opening, a plurality of springs disposed between the elastomeric disc and the platform, and including a tubular washer bonded to the elastomeric disc within the central opening. The tubular washer has a convex surface facing the top surface of the supporting platform. A cushion assembly is located between the piston and the platform and comprises an elastomeric disc with a central opening, a plurality of springs disposed on either side of the disc intermediate the platform and the piston, and a wobble tube bonded to the elastomeric disc within the central opening thereof. The wobble tube within the cushion assembly has convex opposing faces contacting the lower surface of the supporting platform and the upper surface of the piston. Further, bolt means are provided which extend through the washer assembly, platform and cushion assembly with the bolt means threadedly engaging the piston to connect the piston to the platform.

BRIEF DESCRIPTION OF DRAWINGS

A more complete understanding of the invention and its advantages will be apparent from the following Detailed Description taken in conjunction with the accompanying Drawings in which.

DETAILED DESCRIPTION

Figure 1:
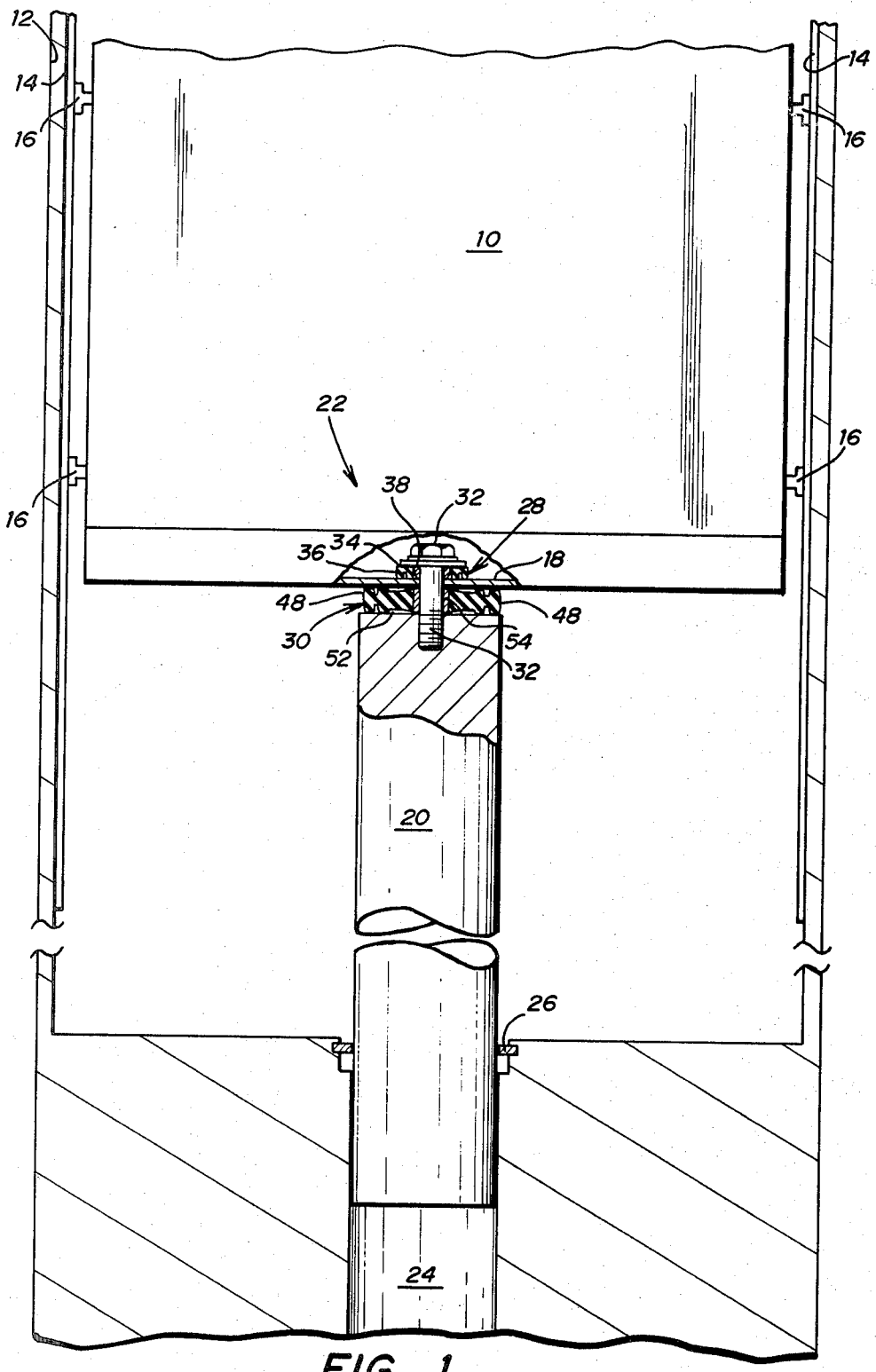
FIG. 1 is an elevation view, partially in section, of an elevator car, piston and connection assembly in accordance with the present invention.

Referring to FIG. 1, there is illustrated an elevator car 10 which moves vertically in a shaft 12 along guide rails 14. The elevator car 10 is positioned between the guide rails 14 by a plurality of sliding guides 16.

Elevator car 10 is supported by a platform 18 which is joined to a hydraulic piston 20 by means of a elevator connection shown generally as 22. Piston 20 operates within a cylinder 24 that receives pressurized fluid to raise and lower the piston 20 which in turn positions the elevator car 10 within the shaft 12. A pressure seal is maintained between the piston 20 and the cylinder 24 by means of a packing 26.

The connection 22 comprises the combination of a washer assembly 28, a cushion assembly 30 and a stud bolt 32.

Figure 2:
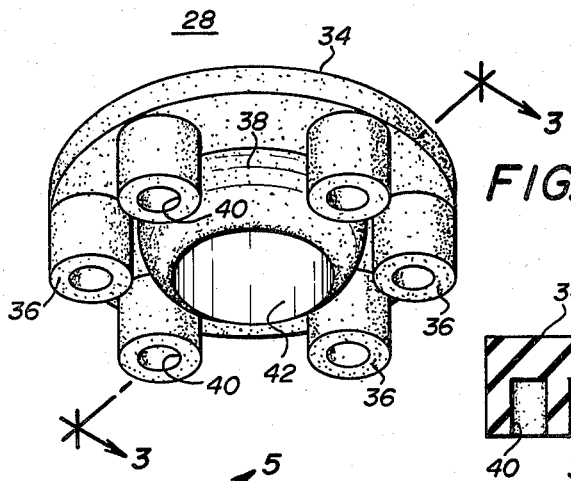
FIG. 2 is a perspective view of an elastomeric washer assembly and enclosed tubular washer of the present invention.
Figure 3:
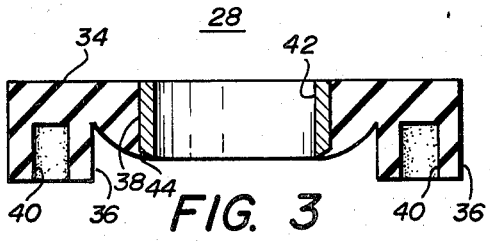
FIG. 3 is a sectional view of the washer assembly shown in FIG. 2.

Washer assembly 28, which is illustrated in greater detail in FIGS. 2 and 3, includes an elastomeric disc 34, a plurality of springs 36 and a center support 38. Each of the springs 36 is in the shape of a tube having an interior hole 40. Disc 34, springs 36 and support 38 are formed as an integral elastomeric unit fabricated of a material such as natural or synthetic rubber. The support 38 has a central opening which contains a tubular washer 42. The washer 42 has its outer surface bonded to the interior surface of the support 38 so that the tubular washer 42 is firmly held in place within the washer assembly 28. The lower end of the tubular washer 42 is beveled to have a convex shaped surface 44 facing downward toward the platform 18. The elastomeric material of the central support 38 tapers to overlap the beveled surface 44 of the tubular washer 42.

Figure 4:
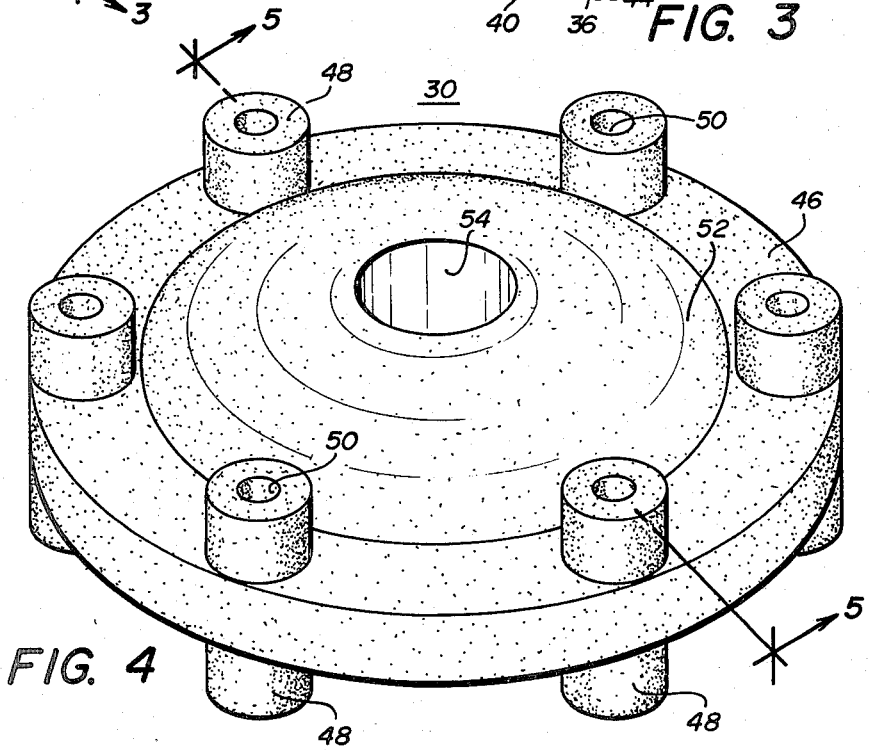
FIG. 4 is a perspective view of an elastomeric cushion assembly and wobble tube of the present invention.
Figure 5:
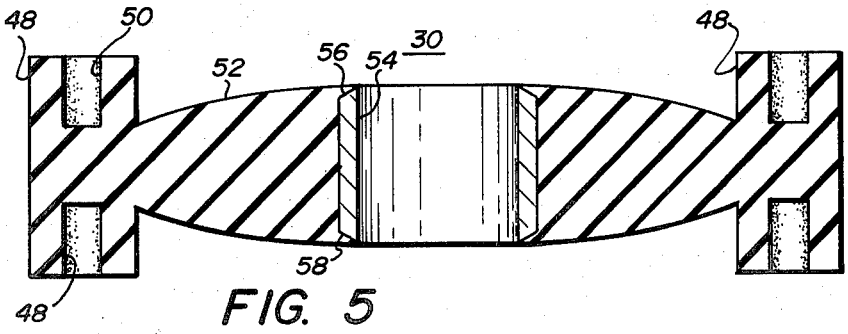
FIG. 5 is a sectional view of the cushion assembly shown in FIG. 4.

The cushion assembly 30 illustrated in FIG. 1 is shown in further detail in FIGS. 4 and 5. Cushion assembly 30 includes an elastomeric disc 46 which has joined on both sides thereof a plurality of springs 48. The springs 48 are located on both surfaces of the disc 46 to space the disc 46 away from both the platform 18 and the piston 20. Each of the springs 48 is of a tubular shape with a cylindrical interior opening 50.

The elastomeric disc 46 has a center support 52 which has axially disposed therein a wobble tube 54. The wobble tube 54 has beveled ends forming convex surfaces 56 and 58 on both the upper and lower ends thereof. The disc 46, springs 48 and center support 52 are formed as an integral elastomeric unit fabricated of a material such as natural or synthetic rubber. The elastomeric material of the center support 52 overlaps the convex surfaces 56 and 58. The elastomeric material of the cushion assembly 30 is securely bonded to the wobble tube 54.

In FIG. 1, the washer assembly 28 and cushion assembly 30 are shown as distorted under the compressive load of the elevator car 10. These assemblies are shown in the unstressed state in FIGS. 2–5.

Referring to FIG. 1 the elevator connection 22 of the present invention is utilized to join the elevator car 10 to the hydraulic piston 20. A problem which frequently arises in hydraulic elevator installations is that the cylinder 24, which contains the piston 20, is not properly aligned with the guide rails 14 which position the elevator car 10 within the shaft 12. In most installations the elevator car 10 is rigidly connected to the piston 20. Where there is misalignment between the piston and guide rails the friction between these members becomes more serious as the car rises to a greater height. Misaligment causes the sliding guides 16 to be forced against the guide rails 14 with the resulting friction causing the sliding guides to bind and inhibit the movement of the elevator car. The binding friction between the sliding guides and the guide rails often causes the car to vibrate and thereby produce an unpleasant ride for the passengers. Further, the constant binding over a period of time increases the wear on the elevator components and leads to early equipment failure.

The connection 22 of the present invention permits the elevator car 10 to both pivot and offset slightly about the top of the piston 20 so as to align the car 10 despite misalignment of the piston 20 with the guide rails 14. The stud bolt 32 is rigidly connected to the top of the piston 20 while it compresses the washer assembly 28 and cushion assembly 30 therebetween. The stud bolt 32 is tightened sufficiently so that there is metal-to-metal contact from the head of the stud bolt downward through each component to the top of the piston 20. The base of the head of the stud bolt 32 is flat and mates with the flat upper surface of the tubular washer 42 which is fabricated of a rigid metal such as steel.

The base of the tubular washer 42 is formed to have a surface 44 that is convex downward and in contact with the upper surface of the platform 18. The lower surface of the platform 18 contacts the upper convex surface 56 of the wobble tube 54. Likewise, the lower surface 58 of tube 54 contacts the upper surface of the piston 20. Note that constant metal-to-metal contact is maintained immediately along the outer periphery of the stud bolt 32. The weight of the car 10 is carried uniformly about the stud bolt 32 when the piston 20 is correctly aligned with the guide rails 14. But, when the piston and guide rails are misaligned the elevator car 10 is caused to tilt slightly with respect to the top of the piston 20. The tilt of the elevator car 10 causes the head of the stud bolt 32 to compress a segment of the elastomeric disc 34. As the elevator car 10 is tilted the platform 18 is moved out of parallel alignment with the head of the stud bolt 32. The tubular washer 42 however remains parallel to the head of the stud bolt 32. Thus, in effect the platform 10 is rolled slightly about the lower surface of the tubular washer 42. The springs 36 and disc 34 of the washer assembly 28 are distorted to absorb misalignment of the car and piston.

As the platform 18 is tilted away from the vertical the cushion assembly 30 and its springs are also compressed along a given segment. The platform 18 rolls about the upper surface 56 of the wobble tube 54 and shifts the contact to one segment of the tube 54 on a side of the stud bolt 32. Thus, within the limits of misalignment generally encountered in hydraulic elevator installations, the connection 22 will permit the elevator car to align with the guide rails while maintaining metal-to-metal contact to support the car 10 on the piston 20. The elastomeric material of the washer assembly 28 and cushion assembly 30 also permits the platform 18 to translate horizontally to a limited extent relative to the top of the piston 20. This is accomplished through shear of these two elastomeric members.

It has been shown in a test installation that a guide rail misalignment of up to three inches in a twenty foot elevation above the cylinder 24 can be accommodated by the elevator connection 22 of the present invention. Such a misalignment was tolerated with little or no degradation in the operation of the elevator system. Further the frictional wear on the system was substantially reduced due to the compensation permitted by the elevator connection 22. In addition, the ride was also made smoother due to vibration absorption by the elastomeric members in assemblies 28 and 30.

Although an exemplary embodiment of the invention has been illustrated in the accompanying drawings and described in the foregoing Detailed Description, it will be understood that the invention is not limited to the embodiment disclosed, but is capable of numerous rearrangements, modifications and substitutions without departing from the scope of the invention.

I claim:

1. In a hydraulic elevator where a car is supported by a platform and guided by vertical rails in an elevator shaft with the car and platform raised and lowered by a hydraulic piston, apparatus for connecting the piston to the platform to support the platform and accommodate misalignment between the piston and the guide rails, said apparatus comprising in combination, (a) a washer assembly located on the upper surface of said platform and comprising a first elastomeric disc having a central opening, a plurality of springs disposed between said elastomeric disc and said platform, and a first tubular member bonded to said elastomeric disc axially within said central opening, (b) a cushion assembly located between said piston and said platform and comprising a second elastomeric disc with a central opening, a plurality of springs disposed on either side of said second disc intermediate said platform and said piston, and a second tubular member bonded to said second elastomeric disc within said central opening, and (c) bolt means extending through said washer assembly, said platform and said cushion assembly, said bolt means engaging said piston to connect said platform to said piston with rigid contact being made sequentially between the head of said bolt, said first tubular member, said platform, said second tubular member and the top of said piston, said rigid contact being maintained during misalignment between the piston and the guide rails.

2. Apparatus as recited in claim 1 wherein said first tubular member has an end thereof beveled to form a convex surface facing said platform.

3. Apparatus as recited in claim 1 wherein said second tubular member has a first end thereof beveled to form a convex surface facing said platform and a second end thereof beveled to form a convex surface facing said piston.

4. Apparatus as recited in claim 1 wherein said first elastomeric disc and adjacent springs are an integral elastomeric unit, said springs comprising tubular elements equally spaced about the axis of said first disc, the axes of said tubular elements normal to the surface of said disc.

5. Apparatus as recited in claim 1 wherein said second elastomeric disc and the springs adjacent thereto are an integral elastomeric unit, said springs comprising tubular elements equally spaced about the axis of said second disc on both sides thereof, said tubular elements having the axes thereof normal to said second disc.

6. Apparatus as recited in claim 1 wherein said first elastomeric disc is flat on the surface thereof opposite said platform and has a greater thickness at the center region and a lesser thickness toward the periphery thereof.

7. Apparatus as recited in claim 1 wherein said second elastomeric disc has a greater thickness in the central region and a lesser thickness toward the periphery thereof.

8. In a hydraulic elevator where a car is supported by a platform and guided by vertical rails in an elevator shaft with the car and platform raised and lowered by a hydraulic piston connected by a stud bolt to the platform, apparatus for accommodating misalignment between the piston and guide rails, comprising in combination, (a) a rigid tubular washer slidably engaged on said bolt contiguous with the head thereof, said tubular washer having a beveled convex end facing the upper surface of said platform, (b) a first elastomeric pad enclosing the periphery of said tubular washer and disposed between the head of said bolt and the upper surface of said platform, (c) a rigid wobble tube slidably engaged on said bolt, having beveled convex upper and lower ends respectively contiguous the lower surface of said platform and the top of said piston, rigid contact being made sequentially between the head of said bolt, said tubular washer, said platform, said wobble tube and the top of said piston, said contact being maintained during misalignment between the piston and the guide rails, and (d) a second elastomeric pad enclosing the periphery of said wobble tube and disposed between the lower surface of said platform and the top of said piston, said elastomeric pads permitting limited movement of said platform in relation to said piston for accommodating misalignment of said rails with said piston.

9. Apparatus as recited in claim 8 wherein said first elastomeric pad is bonded to said tubular washer and extends outward beyond the head of said bolt.

10. Apparatus as recited in claim 8 wherein said second elastomeric pad is bonded to said wobble tube and extends outward from said wobble tube to serve as a cushion between said platform and said piston.

11. Apparatus as recited in claim 8 including a plurality of elastomeric spring elements integrally formed with said first elastomeric pad and located intermediate said first elastomeric pad and said platform.

12. Apparatus as recited in claim 8 including a plurality of elastomeric spring elements integrally formed on either side of said second elastomeric pad.

13. Apparatus as recited in claim 8 wherein said first elastomeric pad is of lesser diameter than said second elastomeric pad.

* * * * *